US006857938B1

(12) United States Patent
Smith et al.

(10) Patent No.: US 6,857,938 B1
(45) Date of Patent: Feb. 22, 2005

(54) LOT-TO-LOT FEED FORWARD CMP PROCESS

(75) Inventors: Eugene C. Smith, Apple Valley, MN (US); Russell J. Elias, Tempe, AZ (US)

(73) Assignee: Cypress Semiconductor Corporation, San Jose, CA (US)

( * ) Notice: Subject to any disclaimer, the term of this patent is extended or adjusted under 35 U.S.C. 154(b) by 91 days.

(21) Appl. No.: 10/320,012

(22) Filed: Dec. 16, 2002

(51) Int. Cl.[7] ..... B24B 49/00; B24B 51/00; B24B 1/00; B24B 5/00

(52) U.S. Cl. ..... 451/5; 451/41; 451/287

(58) Field of Search ..... 451/5, 6, 8, 285–290, 451/41, 56, 57, 60; 438/15, 16, 17, 690, 692

(56) References Cited

U.S. PATENT DOCUMENTS 5,503,962 A 4/1996 Caldwell
5,897,371 A 4/1999 Yeh et al.
5,913,712 A 6/1999 Molinar
5,945,346 A * 8/1999 Vanell et al. ..... 438/691
6,008,119 A * 12/1999 Fournier ..... 438/633
6,517,412 B2 * 2/2003 Lee et al. ..... 451/5
6,623,333 B1 * 9/2003 Patel et al. ..... 451/9
6,690,473 B1 * 2/2004 Stanke et al. ..... 356/601
2003/0193050 A1 * 10/2003 Park et al. ..... 257/48

OTHER PUBLICATIONS

Elias, Russell, "Demand Signal Modeling: A Model–Based Approach to the Forecasting of Future Product Demand", pp. 1–98, Arizona State University, 2000.
Boning, Duane, et al, "Run by Run Control of Chemical-Mechanical Polishing", IEEE Trans. CPMT (C), vol. 19, No. 4, pp. 307–314, Oct. 1996.

* cited by examiner

*Primary Examiner*—M. Rachuba
(74) *Attorney, Agent, or Firm*—Okamoto & Benedicto LLP

(57) ABSTRACT

One embodiment disclosed relates to a chemical-mechanical polishing process. The process includes performing chemical-mechanical polishing on an entire wafer lot without look ahead polishing of a first article wafer. A normalized polish rate is determined, and a process time for a next wafer lot is predicted using the normalized polish rate. Another embodiment of the invention relates to a polishing apparatus for chemical-mechanical planarization of semiconductor wafers.

20 Claims, 11 Drawing Sheets

300

100

| | | | | | | |
|---|---|---|---|---|---|---|
| | | | QUAL 1 $_{time_in}$ | QUAL 1 $_{thickness}$ | QUAL 1 $_{pad_hrs}$ | CUAL 1 $_{Filter_hrs}$ |
| Lot 1 Var $_1$ | Lot 1 Var $_2$ | Lot 1 Var $_n$ | Lot 1 Var $_{time_in}$ | | | |
| Lot 2 Var $_1$ | Lot 2 Var $_2$ | Lot 2 Var $_n$ | Lot 2 Var $_{time_in}$ | | | |
| Lot N Var $_1$ | Lot N Var $_2$ | Lot N Var $_n$ | Lot N Var $_{time_in}$ | | | |
| | | | QUAL 2 $_{time_in}$ | QUAL 2 $_{thickness}$ | QUAL 2 $_{pad_hrs}$ | CUAL 2 $_{Filter_hrs}$ |

FIG. 4

| Average of DLC RAW | Mach | | | | | | | | |
|---|---|---|---|---|---|---|---|---|---|
| LayDev | 09 | 10 | 11 | 12 | 14 | 16 | 17 | 18 | Grand Total |
| CMPL_7B55TCAC | | | 1.48 | | | | | | 1.48 |
| CMPL_7B6961AC | | | | | | 1.48 | | | 1.48 |
| CMPL_7B92941AC | | | | | 1.49 | | | 1.45 | 1.47 |
| CMPL_7B95322AC | | | 1.53 | | | | | | 1.53 |
| CMPL_7C0193BC | | | | 2.02 | 1.85 | | | | 1.94 |
| CMPL_7C0260EC | | | | | | | 1.98 | | 1.98 |
| CMPL_7C03831BC | | | | | 1.99 | | | 1.90 | 1.94 |
| CMPL_7C03838C | | | | 1.96 | 2.00 | 1.93 | 2.04 | 1.89 | 1.97 |
| CMPL_7C0430AC | | | | 1.23 | 1.28 | | 1.41 | 1.31 | 1.30 |
| CMPL_7C08523AC | | | 1.14 | 1.27 | 1.23 | | | | 1.24 |
| CMPL_7C1021FC | | | 1.12 | | | 1.11 | | | 1.12 |
| CMPL_7C11262BC | | | | 1.25 | 1.30 | 1.23 | 1.26 | 1.26 | 1.27 |
| CMPL_7C1128HC | | | 1.33 | 1.28 | 1.31 | 1.34 | 1.38 | 1.38 | 1.33 |

FIG. 6

| Tool | AR1 | Intercept |
|---|---|---|
| 409 | -0.510 | 0.0225 |
| 410 | -0.451 | 0.0177 |
| 411 | -0.424 | -0.0117 |
| 412 | -0.455 | 0.0097 |
| 414 | -0.502 | -0.0050 |
| 416 | -0.477 | 0.0024 |
| 417 | -0.457 | 0.0003 |
| 418 | -0.451 | 0.0038 |

FIG. 10

LOT-TO-LOT FEED FORWARD CMP PROCESS

BACKGROUND OF THE INVENTION

1. Field of the Invention

The invention relates generally to semiconductor manufacturing. More particularly, the invention relates to processes for chemical mechanical polishing (CMP).

2. Description of the Background Art

Chemical Mechanical Polishing or Chemical Mechanical Planarization (CMP) is an industry recognized process for making silicon wafers flat. The CMP process is used to achieve global planarization (planarization of the entire wafer). Both chemical and mechanical forces produce the desired polishing of the wafer. The CMP process generally includes an automated rotating polishing platen and a wafer holder. The wafer holder is generally used to hold the wafer in place while the platen exerts a force on the wafer. At the same time, the wafer and platen may be independently rotated. A polishing slurry feeding system may be implemented to wet the polishing pad and the wafer. The polishing pad bridges over relatively low spots on the wafer, thus removing material from the relatively high spots on the wafer. Planarization occurs because generally high spots on the wafer polish faster than low spots on the wafer. Thus, the relatively high portions of the wafer are smoothed to a uniform level faster than the other, relatively low portions of the wafer.

FIG. 1 is a flow chart depicting a conventional CMP process for polishing wafer lots. A wafer lot is a group of wafers that go through various manufacturing steps together. The conventional method 100 is depicted using five steps (102, 104, 106, 108, and 110).

In the first step 102, chemical-mechanical polishing is performed for a "first article" or "look ahead" wafer selected from the wafer lot to be polished. Because the first article polishing is monitored to determine an appropriate process time, the first article polishing is disadvantageously operator intensive. Furthermore, the first article polishing disadvantageously occupies the CMP tool and so reduces the available time to polish the wafer lots. In other words, the first article polishing reduces the throughput (units per hour or UPH) of the CMP process. In addition, the first article wafer may have differences from the remainder of the wafer lot, and such differences may result in less accurate polishing of the remaining wafers and the need for rework if required specifications for the polishing are not met.

In the second step 104, a process time is calculated based on measurements from the CMP of the first article wafer. In the third step 106, the process time for CMP of the remaining wafers is set to be the calculated process time. CMP is performed for the remaining wafers of the wafer lot in the fourth step 108. In the fifth step 110, the process goes to the next lot of wafers. The process then begins again with the first step 102 where CMP is performed on the first article wafer.

FIG. 2 is a screen shot of a runcard of a conventional CMP process. In particular, a first article wafer is polished in the substep #3 labeled "CMP_TW" (chemical mechanical polish of test wafer), and the remaining wafers are polished in the substep #4 labeled "CMP_Lot" (chemical mechanical polish of lot).

While progress has been made in CMP processes, further improvement is desired to improve them. For instance, improvement in the throughput of CMP processes is desirable.

SUMMARY

One embodiment of the invention relates to a chemical-mechanical polishing process. The process includes performing chemical-mechanical polishing on an entire wafer lot without look ahead polishing of a first article wafer. A normalized polish rate is determined, and a process time for a next wafer lot is advantageously predicted using the normalized polish rate.

Another embodiment of the invention relates to a polishing apparatus for chemical-mechanical planarization of semiconductor wafers. The apparatus includes a CMP machine, a control mechanism operatively coupled to the CMP machine, and a computing mechanism operatively coupled to the control mechanism. The CMP machine is configured to polish an entire wafer lot without look ahead polishing of a first article wafer, and the control mechanism controls a process time for polishing wafer lots. Advantageously, the computing mechanism calculates a normalized polish rate for a preceding wafer lot and predicts a process time for a next wafer lot using the normalized polish rate derived from the preceding wafer lot.

BRIEF DESCRIPTION OF THE DRAWINGS

FIG. 4 is a table showing an example database structure that includes lot-based and tool-based information in one spreadsheet in accordance with an embodiment of the invention.

FIG. 6 depicts an example of average DLC calculations in accordance with an embodiment of the invention.

FIG. 10 is a table showing parameter estimates for a fleet of tools in accordance with an embodiment of the invention.

The use of the same reference label in different drawings indicates the same or like components. Drawings are not necessarily to scale unless otherwise noted.

DETAILED DESCRIPTION

In the present disclosure, numerous specific details are provided, such as examples of apparatus, components, and methods to provide a thorough understanding of embodiments of the invention. Persons of ordinary skill in the art will recognize, however, that the invention can be practiced without one or more of the specific details. In other instances, well-known details are not shown or described to avoid obscuring aspects of the invention.

Figure 3:
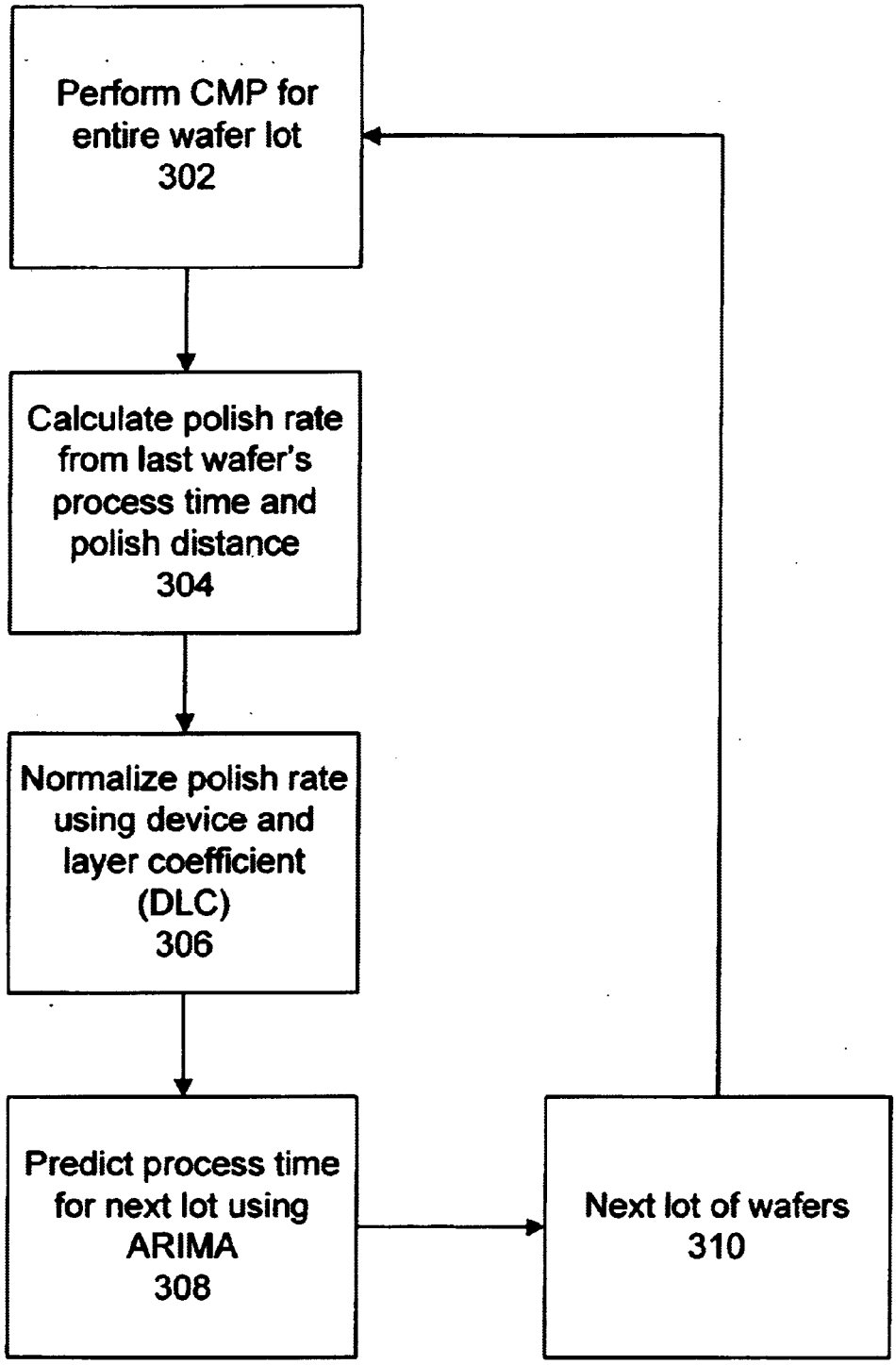
FIG. 3 is a flow chart depicting a CMP process for polishing wafer lots in accordance with an embodiment of the invention.

FIG. 3 is a flow chart depicting a CMP process for polishing wafer lots in accordance with an embodiment of the invention. The method 300 is depicted using five steps (302, 304, 306, 308, and 310).

In the first step 302, chemical-mechanical polishing is performed for an entire wafer lot. This advantageously avoids the operator intensive first article polishing step 102 of the conventional method 100.

In the second step 304, a process rate is calculated from the polish time and polish distance of the "last wafer," where the "last wafer" refers to a wafer (or more than one wafers) from the just processed wafer lot.

In the third step 306, the process rate is normalized. As described in further detail below, the normalization may be done using a device and layer coefficient (DLC) in accordance with an embodiment of the invention. Normalization using the DLC advantageously compensates for variations in circuits and materials between wafer lots.

A prediction of the process time for the next wafer lot is performed in the fourth step 308. The prediction may utilize a model to advantageously analyze the data from one or more previous lots. In one particular embodiment of the invention, the model used is an autoregressive integrated moving average (ARIMA) model. Application of the ARIMA model provides an advantageous smoothing effect that allows for a more accurate prediction of a next process time based upon past data.

In the fifth step 310, the process goes to the next lot of wafers. The process then begins again with the first step 302 where CMP is advantageously performed on the entire next lot.

The following descriptions provide further details relating to an embodiment of the invention.

Database Creation

In developing embodiments of the present invention, data from eight polish tools were gathered over a month and a half to generate a table with about 2,500 rows of data. A spreadsheet (database) was generated that contained the following data as retrieved from the manufacturing execution system: lot #; step; device; process (technology); machine number; logging date/time into step; process time; pre-thickness ("last wafer") from deposition; final thickness from CMP; and target from the statistical process control (SPC) chart. Tool-based data was also extracted from the SPC work environment. The following data was generated: tool; date/time; pre-thickness (thickness after deposition but before polishing); post thickness (thickness after polishing); filter hours; and pad hours. The database was then sorted by tool and time to allow for pad change characterization. This allowed combining the lot-based and tool-based information into one spreadsheet. FIG. 4 is a table showing an example database structure that includes lot-based and tool-based information in one spreadsheet in accordance with an embodiment of the invention. The lot-based information illustrated includes various variables ($Var_1$, $Var_2$, $Var_n$, and $Var_{time_in}$) for various wafer lots (Lot 1, Lot 2, Lot N). The tool-based information includes various variables (time_in, thickness, pad_hrs, filter_hrs) for different tools (QUAL 1, QUAL 2). A tool qualification test (qualification or QUAL) is done using a flat wafer when a new pad is installed on a machine. A qualification occurs periodically due to certain events, for example, when a polishing pad change occurs. Of course, the database structure will include more variables and information than is shown in FIG. 4. The following parameters were then calculated and added to the database as additional columns: polish distance of last wafer (pre-thickness minus final thickness in angstroms of the same "last" wafer); raw polish rates; and delta to target (target thickness minus final thickness).

Advanced Term Calculations

Figure 5:
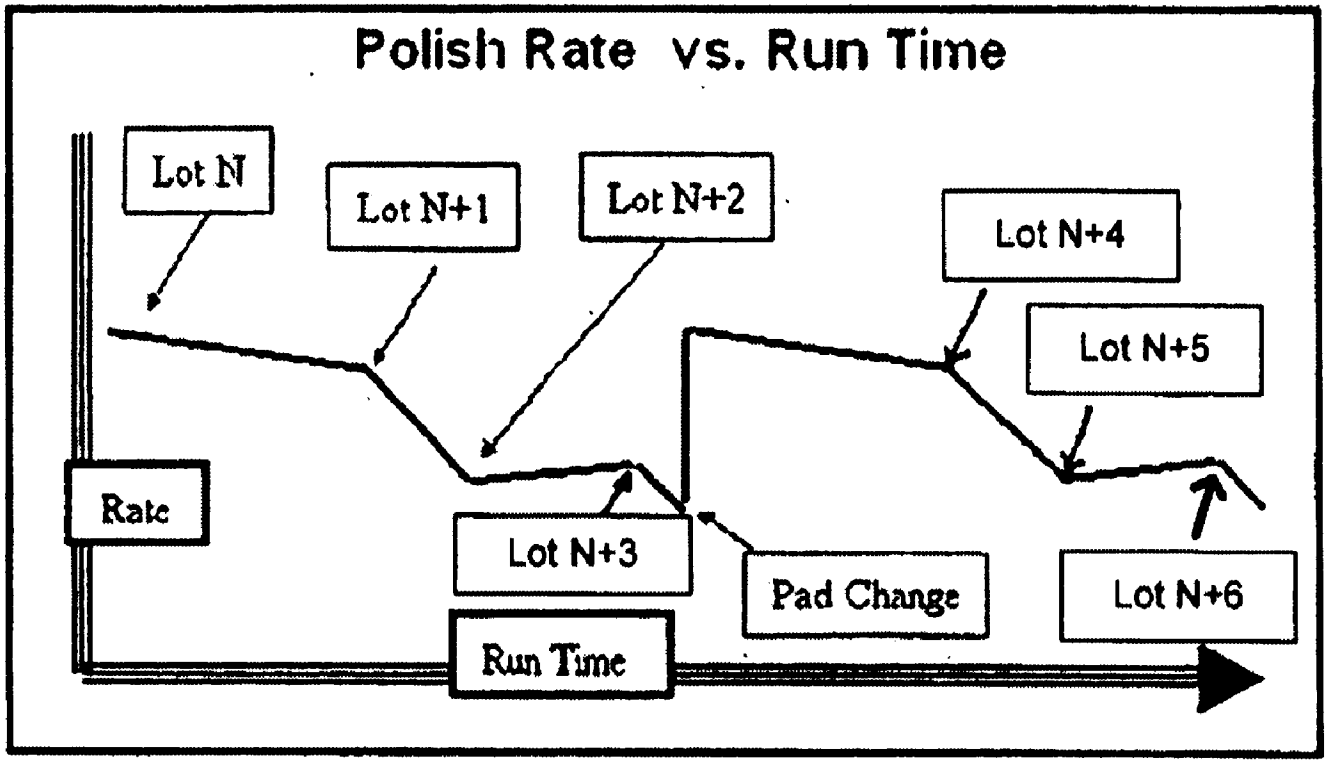
FIG. 5 is a diagram illustrating a simplified model in accordance with applicants' understanding of the CMP process.

In accordance with embodiments of the present invention, a polish rate may be calculated from the previous lot based upon the "last" wafer's process time and polish distance. This rate is then used to calculate the process time for the next lot's "first wafer distance to target." FIG. 5 is a diagram illustrating a simplified model in accordance with applicants' understanding of the CMP process. Polish rate is graphed as a function of run time. The polish rate for Lots N, N+1, N+2, N+3, N+4, and N+5 are shown in FIG. 5. The graph begins on the left showing the polish rate for Lot N. The rate for Lot N decreases along a steady slope as run time progresses. A discontinuity in the slope occurs when the polishing of Lot N finishes and the polishing of Lot N+1 begins. The rate for Lot N+1 decreases along a steeper slope. Another discontinuity in the slope occurs when the polishing of Lot N+i finishes and the polishing of Lot N+2 begins. The rate for Lot N+2 increases along a relatively flat slope. Another discontinuity in the slope occurs when the polishing of Lot N+2 finishes and the polishing of Lot N+3 begins. During the polishing of Lot N+3 a pad change occurs. At the point where the pad change occurs, the polishing rate jumps due to use of the new pad. A discontinuity in the slope occurs when the polishing of Lot N+3 finishes and the polishing of Lot N+4 begins. And so on.

Since the different wafer lots have different devices having different circuit densities with different layers of different materials (doped oxide, undoped oxide, doped nitride, undoped nitride, and so on), a way to normalize the polish rate is desirable. In accordance with an embodiment of the present invention, a "device and layer coefficient" (DLC) is calculated for each device/layer combination in the database. The DLC is used to effectively change the distance to be polished by the calculated ratio of the DLC, thus normalizing the polish rate with a controlled procedure.

In order to determine the "normalization" and the correlation of this value to the actual polish rate, the following methodology was employed. The polish rate for this particular pad was calculated from polishing a flat qualification wafer. Qualification tests are done when a new pad is installed on the machine. This rate will also vary pad change to pad change. This rate was then held constant for each run of that pad cycle (the cycle of runs until the next pad was installed). The raw (individual lot) DLC value is calculated for each lot in the database using the following formula:

$$\text{raw } DLC = \text{Distance}/QUAL_Rate/Time \quad \text{(Equation 1)}$$

"Distance" is the actual distance polished (pre-thickness minus final thickness) of the previous lot (sometimes called the "last wafer"). "QUAL_Rate" is the rate per second of the qualification test. This same value will be used for all lots in the pad cycle. "Time" is the polish time in seconds that was used for the previous lot.

The average DLC value for each device/layer combination may then be calculated, for example, using the Microsoft Excel functionality called a "PivotTable" report. A PivotTable report is an interactive table that you can use to quickly summarize large amounts of data. You can rotate its rows and columns to see different summaries of the source data, filter the data by displaying different pages, or display the details for areas of interest. The PivotTable allows you to average, sum, count, etc. and put into a tabled format, the output of one variable or group of variables. The average DLC for each device/layer combination in the database was calculated using the PivotTable "average" function. FIG. 6 depicts an example of average DLC calculations in accordance with an embodiment of the invention. The full database used in developing the invention had a total of 185 device/layer combinations. The device/layer combinations are labeled in the leftmost column. The rightmost column gives the average DLC values.

For each wafer lot, the effect of the specific device/layer on the polish rate is taken into account. The resultant value is termed the raw normalized polish rate or NPR. The raw NPR is calculated using the following formula:

$$\text{raw } NPR = \text{Distance}/\text{Time}/(Avg\ DLC) \quad \text{(Equation 2)}$$

In other words, the raw NPR is calculated by dividing the polish rate by the average DLC value, where the average DLC value comes from the PivotTable calculation and is specific to each device/layer combination.

Our investigation has identified an additional factor that should be accounted for. The factor may be called the compensated rate factor or CRF. As shown by the following equation, the CRF is the ratio of the actual rate of the qualification test (QUAL_Rate) to the target rate of the qualification test (Target_QUAL_Rate).

$$CRF = QUAL_Rate/Target_QUAL_Rate \quad \text{(Equation 3)}$$

In one specific implementation, the target rate of the qualification test is 42.5 angstroms per second (the target distance is 2,550 angstroms and the polish time is 60 seconds).

The actual or compensated NPR may be calculated by the following formula:

$$NPR = (\text{pre-thickness} - \text{target thickness})/(DLC/CRF)/\text{Time} \quad \text{(Equation 4)}$$

Note that this NPR value could have been determined in an alternate manner by directly using the target rate of the qualification test. The NPR values are used in the lot-to-lot analysis and predictions that is described further below.

Polish Time Predictions

In developing embodiments of the invention, the NPR data calculated as described above was entered into a time-series analysis for Westech CMP tools. Analysis determined a preferred modeling methodology and the constant term values to use. In this instance, the time-series analysis is performed using "JMP" software to implement the analysis.

Figure 7:
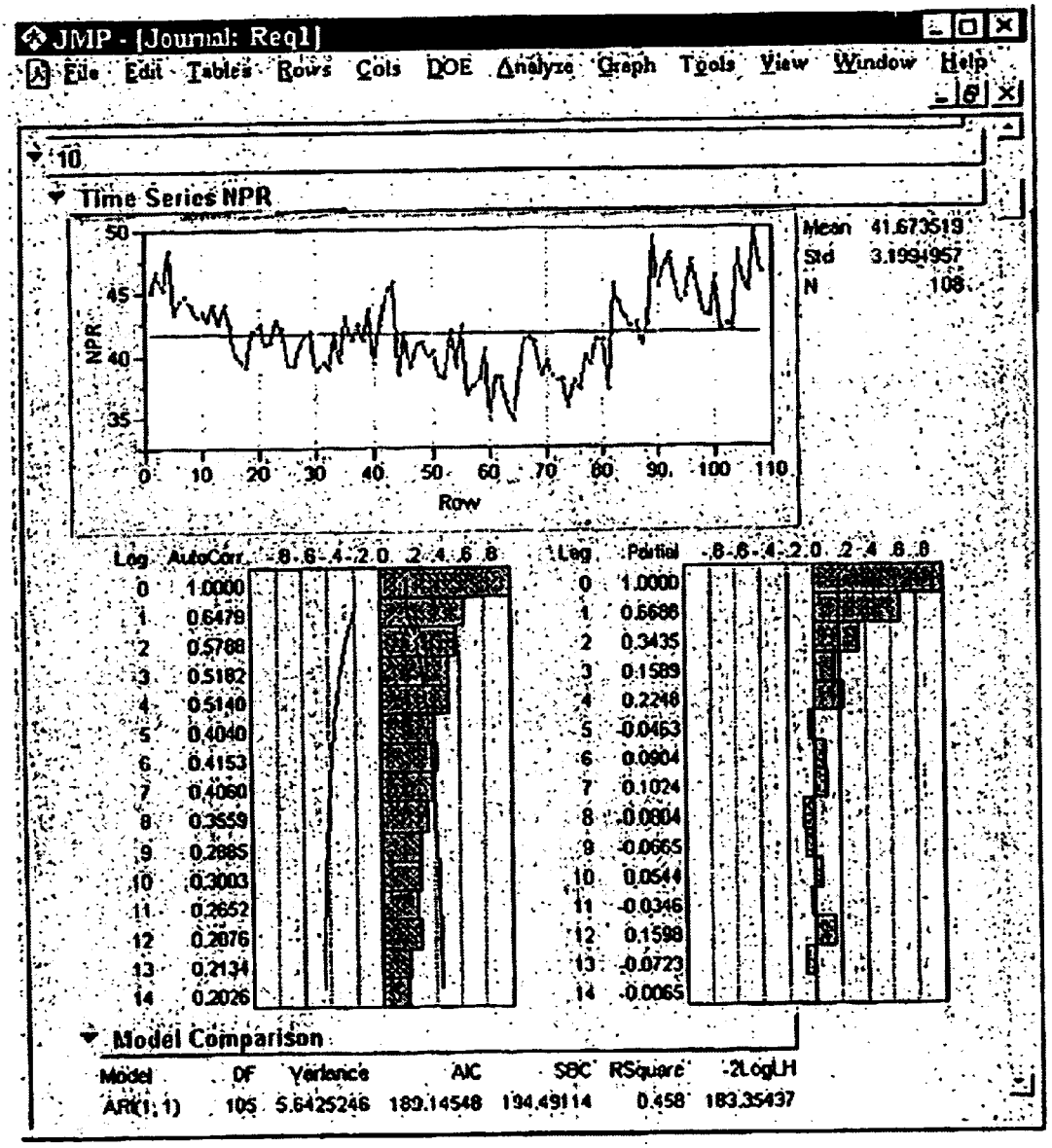
FIGS. 7 through 9 depict an example time-series analysis in accordance with an embodiment of the invention.

The plot near the top of the FIG. 7 actual NPR data from a sequence of over one hundred actual CMP runs on a Westech polishing tool as a function of polishing run (the "Row" on the x-axis). The NPR values are seen to vary from run-to-run in a manner that appears to be rather difficult to predict.

Statistical analysis of the data generates autocorrelation and partial correlation functions. These statistical functions are shown as a function of lag in the bar graphs in the middle of the FIG. 7. The lag of one relates to the statistical correlation between a run and the run just preceding it. The lag of two relates to the statistical correlation between a run and the run that was two runs before it. And so on. As shown by the partial correlation graph, the partial correlation is greater than 0.5 for a lag of one (indicating a relatively substantial correlation) and is less than 0.5 for a lag of two (indicating a less substantial correlation).

Several models were applied to the data in an attempt to find a model that would predict the run-to-run variation in the NPR values. Most of the models resulted in mediocre predictions of the values. However, one model did a relatively good job. That model was the autoregressive integrated moving average (ARIMA) model. The relatively low RSquare value (0.458) at the bottom of FIG. 7 indicates that the predictions were relatively accurate. Details of the ARIMA modeling are described further below.

Figure 8:
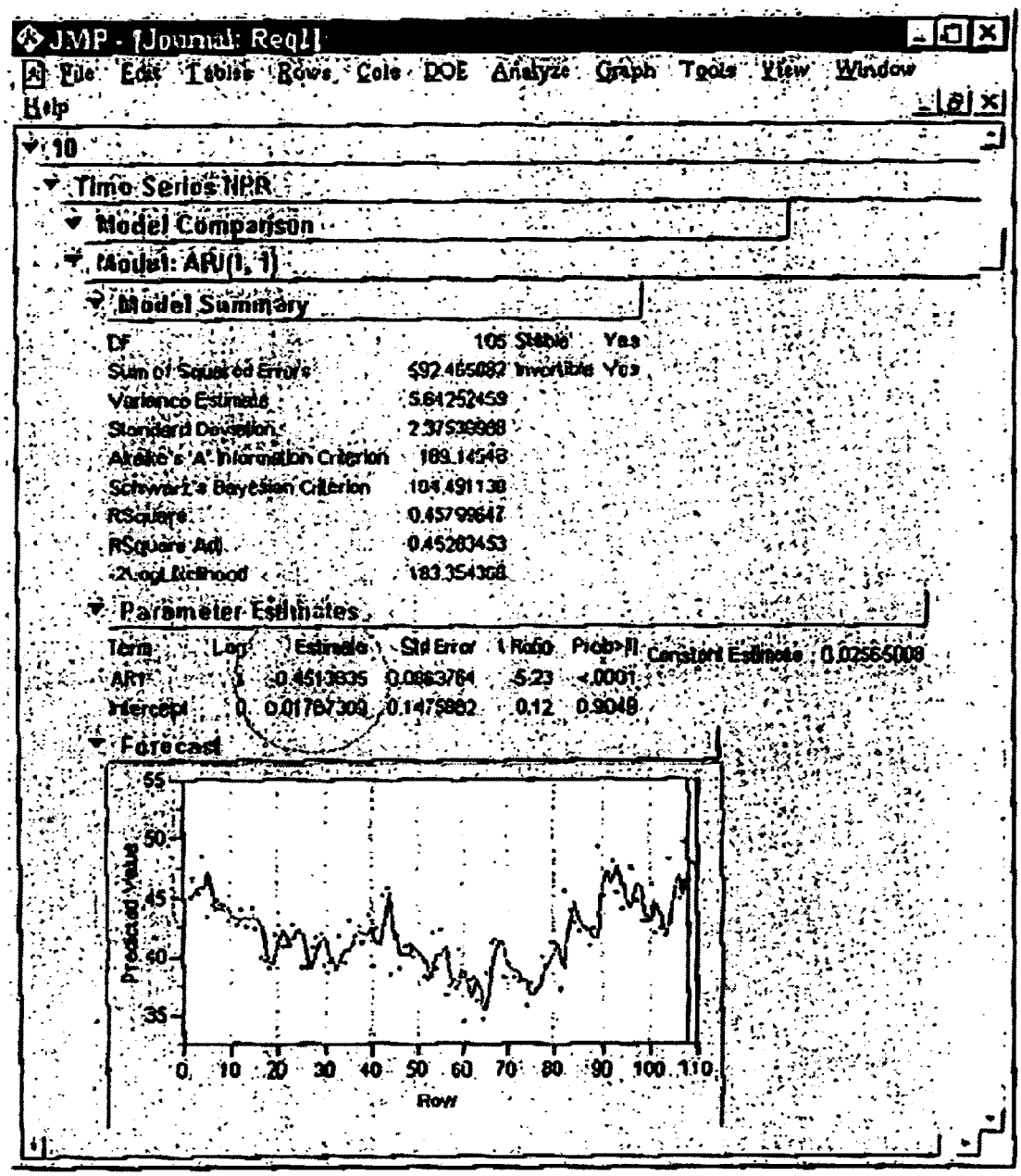

FIG. 8 includes a model summary and parameter estimates showing various values relating to the ARIMA modeling used. The parameter estimates include an AR1 parameter value of −0.451 and an Intercept of 0.01767 (near zero).

The plot near the bottom of FIG. 8 compares the predicted values from the ARIMA-based forecast (line plot) against the actual data (dots) for the lot sequence. The results of the prediction are seen to be quite effective. Hence, it is shown that the ARIMA-based forecasting is surprisingly accurate at making run-by-run CMP predictions.

Figure 9:
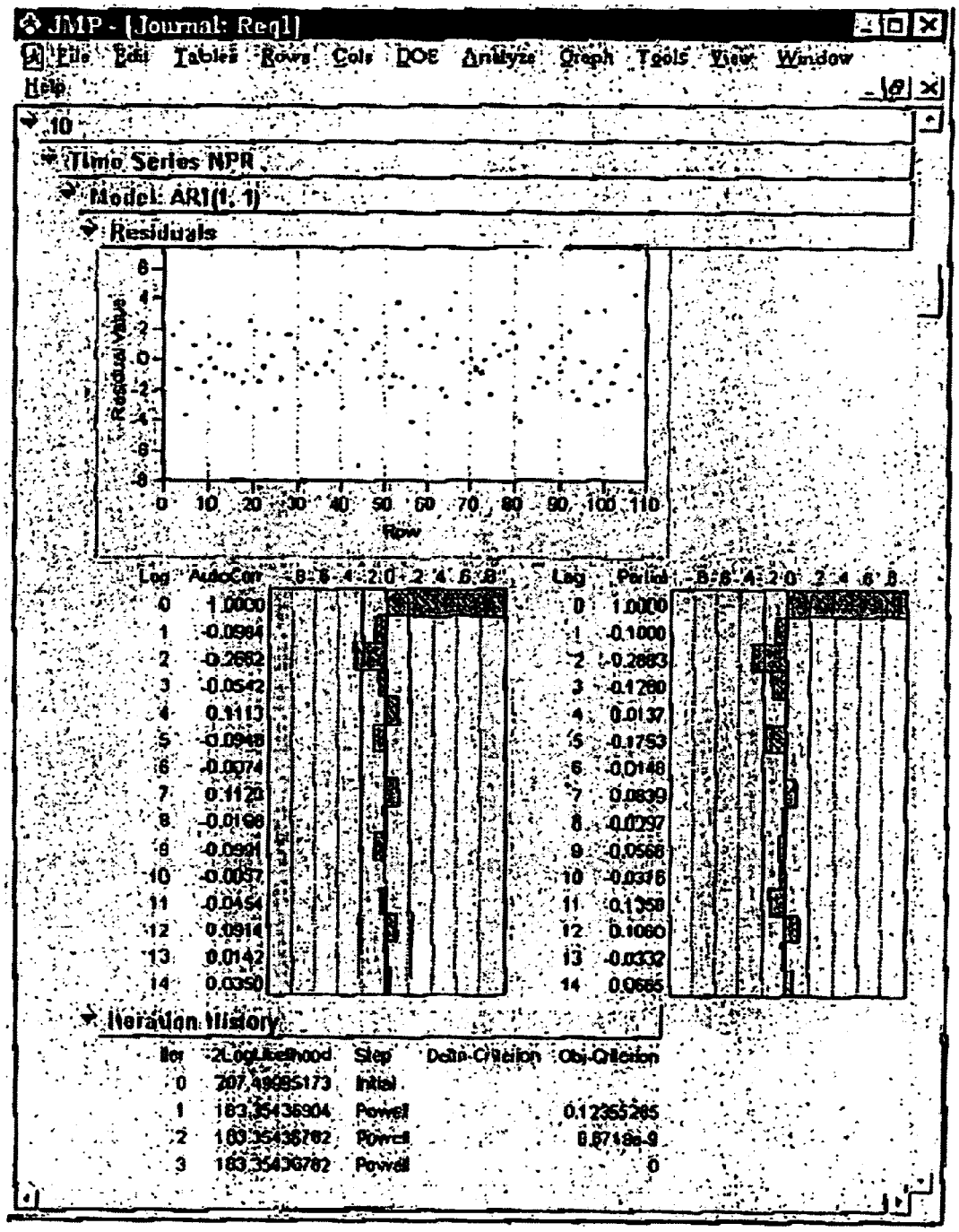

The graph near the top of FIG. 9 depicts residuals of predictions (i.e. the difference between actual and predicted values). As seen, the residuals appear to be random. This is a further positive indication for the ARIMA-based model used. Statistical autocorrelation and partial correlation further supports this by showing that the correlation is near zero from the range of lag 1 through lag 14.

Now the parameter estimates for the ARIMA modeling are discussed in further detail. The parameter estimates depicted in FIG. 8 (AR1 and Intercept) relate to an autoregressive type model and may be inserted into the following formula as follows:

$$\Delta Y(t+1) = \text{Intercept} + AR1 * \Delta Y(t) \quad \text{(Equation 5.1)}$$

where (t) is the last run to be processed and (t+1) is the run that will be processed next. The AR1 parameter is a term relating to the autoregression of the just preceding run. In the example of FIG. 8, the AR1=0.45 and the Intercept =0.0176. That value for the Intercept is near zero. The equation may be further mathematically manipulated as follows.

$$Y(t+1) - Y(t) = \text{Intercept} - AR1 * [y(t) - Y(t-1)] \quad \text{(Equation 5.2)}$$

Normally, there are two runs (at t and t−1) involved with predicting the process time for the next lot (at t+1). In the case of a new pad, the Y(t−1) term does not exist, so the qualification run may then be weighted exclusively to predict the first lot processed. In other words, for the first lot (or few lots) after a qualification test, the processing time calculations for the next lot are made from only the previous lot's NPR. This particular method may be called a "dead band" method since only the last lot is utilized in calculating the next lot's processing time.

Parameter estimates for the fleet of tools (each tool labeled by number) are shown in FIG. 10. From FIG. 10, one can see that the performance results were substantially the same for the various tools in the fleet. This indicated that the model had useful predictive effect and advantageously allowed the applicant to use the same model across the various Westech polishing tools in the fleet.

Further Optimization of DLC Model

As discussed above, the present invention advantageously uses DLC values to improve the automated CMP process. The technique for determining the DLC values to use may be further honed or optimized.

Consider, for example, the situation after the system is initially turned on. There may be a period of time needed to fully populate the database. During this period, a model may be utilized to help determine the DLC values to use in real time. For example, the model may be an exponentially weighted moving average (EWMA) or similar model.

As a side note, investigation was also made into whether the following variables contributed to the distribution of DLC values: deposition compensation (for difference between actual and target deposition thickness); cumulative pad; cumulative filter; pad duty cycle (relates to idle time between lots); and pad device cycle (relates to processing same layer for several lots versus switching from processing one layer to processing a different layer). The result of the investigation was that those variables did not appear to have significant effect on the DLC distribution.

ARIMA Modeling

The ARIMA model is now discussed in further detail. ARIMA stands for autoregressive integrated moving average. In accordance with an embodiment of the invention, use of the ARIMA model to lot-by-lot CMP runs advantageously allows for a more accurate prediction of a next process time based upon past data. The ARIMA model has three parameters: p; d; and q. The order of the autoregressive component is given by p. The order of differencing used is given by d. The order of moving average used is given by q. ARIMA (p,d,q) is the notation indicating the components used for a particular ARIMA model. For example, one particular ARIMA model is the ARIMA(2,1,1) model. ARIMA(2,1,1) refers to a model with a second order autoregressive component, first order differencing component, and a first order moving average component.

Example Results

Figure 1:
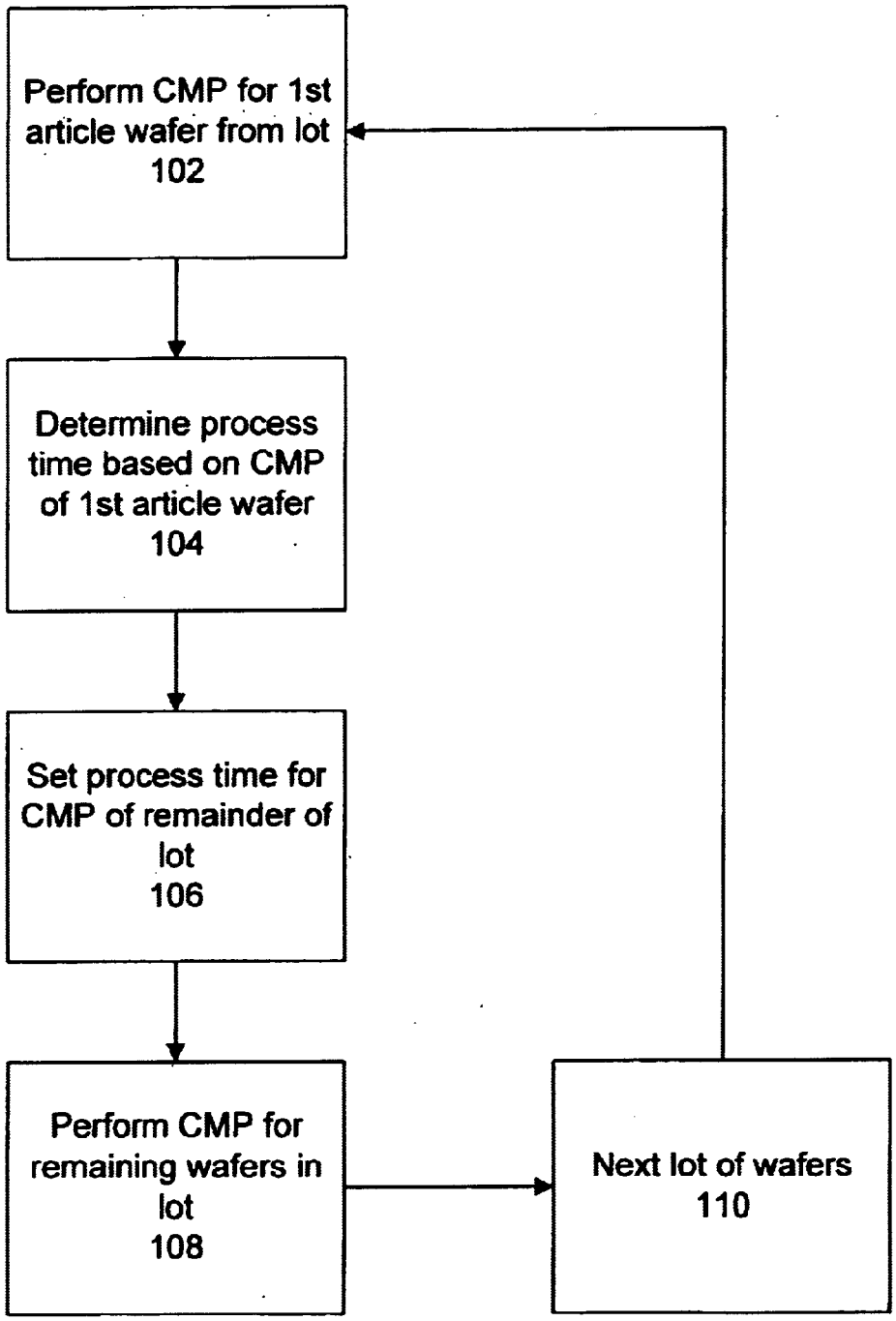
FIG. 1 (Background Art)
FIG. 1 is a flow chart depicting a conventional CMP process for polishing wafer lots.
Figure 2:
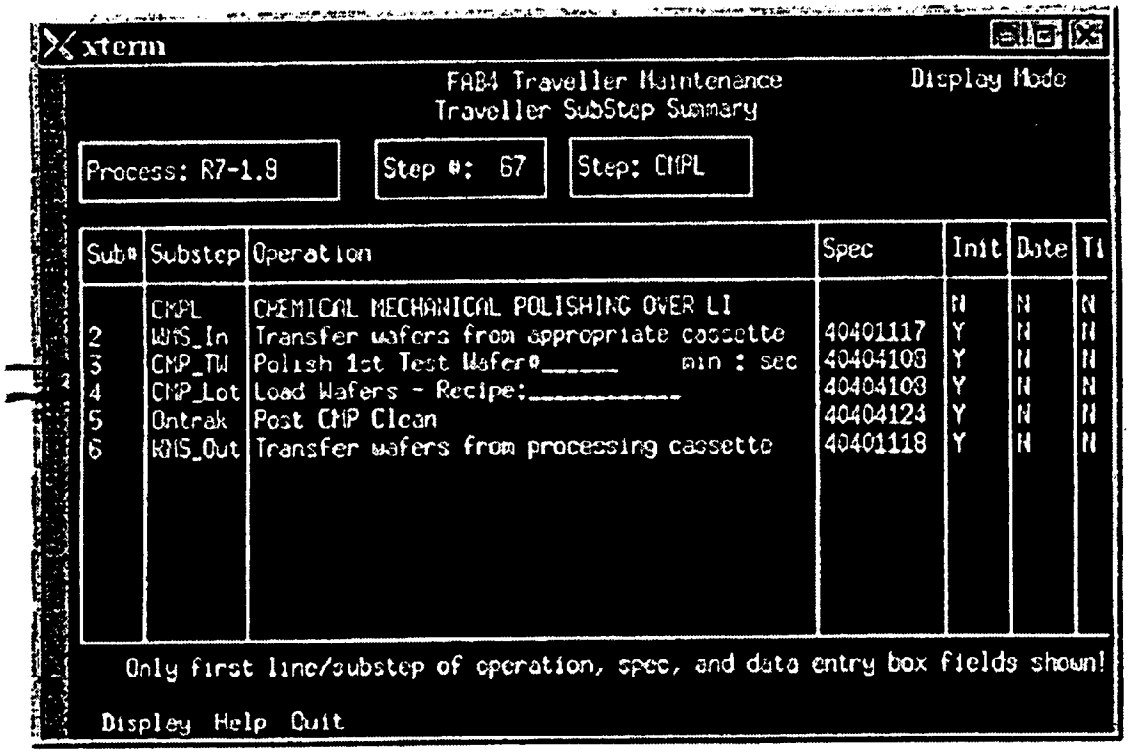
FIG. 2 (Background Art)
FIG. 2 is a screen shot of a runcard of a conventional CMP process.
Figure 11:
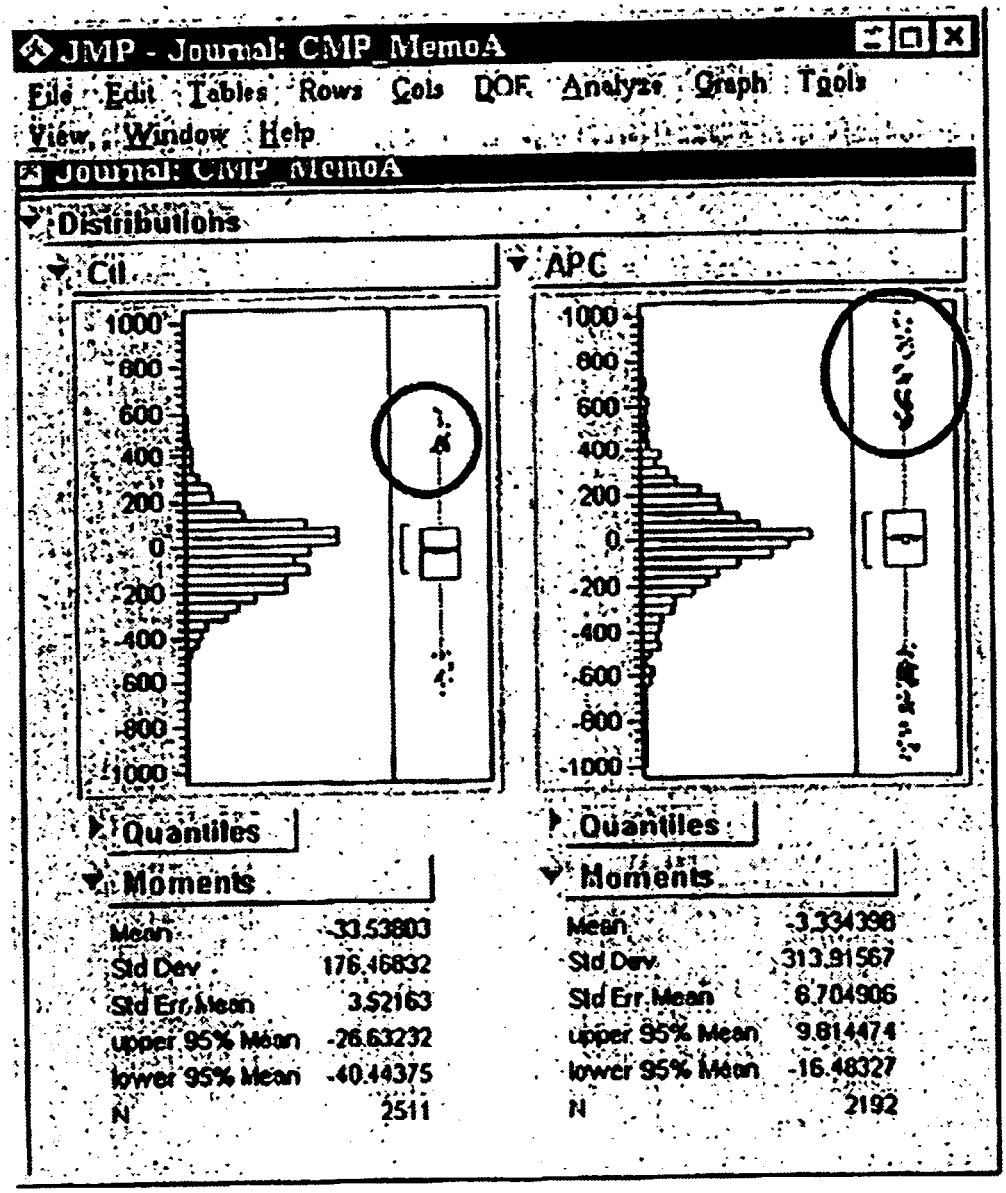
FIG. 11 depicts example results from using an ARIMA model to predict the polishing time for the next lot in accordance with an embodiment of the invention.

FIG. 11 depicts example results from using an ARIMA model to predict the next lot in the database. Results from both control ("ctl") polishing runs and the ARIMA predicted ("APC") polishing runs are shown. The control polishing runs were actual runs where polishing times were determined in accordance with the conventional "first article" method of FIG. 1. The ARIMA predicted polishing runs were theoretical runs where polishing times were determined in accordance with the method of FIG. 3.

The vertical axis of the bar charts indicates the amount of over (positive) or under (negative) polishing. Over polishing is when the polishing goes beyond the target distance. Under polishing is when more polishing is needed to reach the target distance.

The runs that resulted in overpolishing beyond the specification tolerance are circled in FIG. 11. Such runs require scrapping of the wafers. The portion of runs ending up in overpolishing beyond tolerance was similar (about 8%) for control and ARIMA predicted cases. From this, it is seen that the lot-by-lot feed forward polishing method in accordance with an embodiment of the invention achieve similar tolerances as the conventional method. This means that the invention may be advantageously used to eliminate the need for a "first article" run in the CMP process without adversely affecting polishing results. Thus, higher throughput CMP processes may be advantageously achieved with the present invention.

Further Details Time Series Analysis and Forecasting Utilized

A detailed explanation of the theory for time series analysis and forecasting as utilized in accordance with an embodiment of the invention is given as follows. Additional explanation of the theory is given in "Demand Signal Modeling: A Model-Based Approach to the Forecasting of Future Product Demand," by Russell J. Elias, Masters Thesis, Arizona State University, December 2000. The aforementioned thesis is hereby incorporated by reference in its entirety.

A time series is a discrete set of realizations that have an underlying, fundamental sequential time order. A time series may be defined as a sequence of observations taken sequentially in time. A characteristic feature of these sequences of observations, or series, is that typically realizations adjacent to each other in time share some type of interdependence. It is interesting to note that this same interdependence, which in other statistical analysis protocols (e.g., hypothesis testing and design of experiments) is viewed as a corrupting effect, here forms the enabling basis of a powerful methodology that may be called Time Series Analysis.

For a stationary time series (as previously defined), the degree of interdependence between directly adjacent and nearly adjacent realizations can be quantified as an autocorrelation at lag k, or $_{k_1}$ as follows:

$$\rho_k = \frac{E[(y_t - \mu)(y_{t+k} - \mu)]}{\sqrt{E(y_t - \mu)^2 E(y_{t+k} - \mu)^2}} \quad \text{(Equation 6)}$$

where the numerator is the autocovariance at lag k, or $_k$, and the denominator is the lag zero autocovariance, or $_0$, which is equivalent to the variance of the predictand series, $\sigma_y^2$; of course, $\mu$ represents the constant, albeit unknown, mean of the predictand series.

A plot of the autocorrelation coefficient $_k$, versus the lag k is known as the autocorrelation function, or ACF, of the time series, which will later be shown as a key identification tool for correct time series model form. Given that the autocorrelation function is an even function, i.e., that explicitly $_k = -_k$, the function is typically plotted only for positive values of the lag k.

In order to test whether the autocorrelation coefficients are statistically significant (i.e., non-zero in value) at various lags, the predictand series average<Y> is substituted for the unknown mean $\mu$ in Equation 6, which now produces the sample autocorrelation coefficient $r_k$. This sample statistic is compared against its standard error, which is estimated based upon an approximation first forwarded by Bartlett (1946), which states that for a stationary normal process, the variance of the sample autocorrelation coefficient may be estimated as:

$$\mathrm{var}[r_k] \cong \frac{1}{N} \sum_{v=-\infty}^{+\infty} (\rho_v^2 + \rho_{v+k}\rho_{v-k} - 4\rho_k\rho_v\rho_{u-k} + 2\rho_v^2\rho_k^2) \quad \text{(Equation 7.1)}$$

This approximation is operationalized by first specifying a lag value q beyond which the theoretical autocorrelation function is assumed to be statistically equivalent to zero. This assumption is then verified through application of a standard error estimate supported by a simplification of Equation 7.1 in which k>q, as follows:

$$\mathrm{var}[r_k] \cong \frac{1}{N}\left(1 + 2\sum_{v=1}^{q} \rho_v^2\right) \quad \text{(Equation 7.2)}$$

Equation 7.2 is sequentially applied to increasing values of lag q until the assumption of statistical equivalence to zero is supported. The autocorrelation function represents a fundamental tool in the identification of the appropriate time series model form, but must be augmented with another diagnostic tool known as the partial autocorrelation function, or PACF. A formula for the PACF, or $\phi_{kk}$, may be given as follows:

$$\phi_{kk} = \frac{E[y_t - E(y_i))(y_{t+k} - E(y_{t+k}))\ |y_{t+1}, y_{t+2}, \ldots, y_{t+k-1}]}{\sqrt{E[y_t - E(y_t)]^2}\sqrt{E[y_{i+k} - E(y_{t+k})]^2}} \quad \text{(Equation 8]}$$

The quantity of Equation 8 may be qualitatively interpreted as the simple autocorrelation between two observations at lag k (say $y_t$ and $y_{t-k}$) with the effect of the intervening observations ($y_{t+k}$, $y_{t+2}$, . . . , $y_{t+k-1}$) assumed known. In practice, both the ACF and the PACF are automatically calculated for sample predictand series utilizing any of several commercially available statistical software packages, making them readily available to assist in model identification.

The simplest time series model form is the autoregressive model. In this process model, realizations are deemed to emanate from a linear combination of past realizations and a single current random shock. A first order autoregressive model, denoted as AR(1), is represented as:

$$y_t=\xi+\phi_1 y_{t-1}+\epsilon_t \quad \text{(Equation 9)}$$

where $\phi_1$ and $\xi$ represent unknown, to be estimated parameters and $_t$ represents a normally distributed random error component with mean of zero and variance $\sigma^2$($_t$ is sometimes referred to as the white noise shocks). The term "autoregressive" refers to the fact that that the current observation $y_t$ has a regression-type relationship with the previous observation $y_{t-1}$. The AR(1) model is sometimes referred to as the Markov process, because current observations are functions solely of the immediately preceding observation.

The mean of the first order autoregressive process is equal to $$\mu = \frac{\xi}{1-\phi_1} \quad \text{(Equation 10)}$$

and the variance (i.e., for k=0) and autocovariances are given by $$\gamma_k = \phi_1^k \frac{\sigma^2}{1-\phi_1^2} \quad \text{(Equation 11)}$$

The autocorrelation function $_k$ is derived from this equation and is equal to $$\rho_k=\phi_1{}^k \quad \text{(Equation 12)}$$

For positive values of $\phi_1$ the ACF shows exponential decay, and for negative values of $\phi_1$ the ACF shows exponential decay with alternating signs. The PACF for an AR(1) process shows a spike at lag 1, then cuts off. The autoregressive model can be extended to second order, or AR(2) form, as follows, $$y_1=\xi+\phi_1 y_{t-1}+\phi_2 y_{t-2}+\epsilon_t \quad \text{(Equation 13)}$$

through the introduction of a second model parameter $\phi_2$. The mean of an AR(2) process can be shown to be $$\mu = \frac{\xi}{1-\phi_1-\phi_2} \quad \text{(Equation 14)}$$

A recursive relationship is utilized to determine the autocorrelation function for the AR(2) process, beginning with the relationship as follows:

$$\rho_k=\phi_1\rho_{k-1}\phi_2\rho_{k-2} \quad \text{(Equation 15)}$$

Substituting into this equation for k=1, 2 yields:

$$\rho_1=\phi_1+\phi_2\rho_1$$

$$\rho_2=\phi_1\rho_1+\phi_2 \quad \text{(Equations 16 and 17)}$$

These equations are called Yule-Walker equations, and given the values of the $\phi_1$ and the $\phi_2$ parameters from the AR(2) model form, the first two autocorrelations are directly obtainable, and higher order autocorrelations can be found using Equation 15. By substituting the sample autocorrelations $r_k$ for the theoretical autocorrelations $_k$ in the Yule-Walker equations, preliminary estimates of the model parameters are available.

The ACF for an AR(2) process monotonically decreases. The following critical value relates to the ACF:

$$\phi_1{}^{24}\phi_2 \quad \text{(Equation 18)}$$

When this quantity is positive, the ACF monotonically decreases with uniform sign; when this quantity is negative, the ACF monotonically decreases with alternating signs in a sinusoidal fashion. The PACF of an AR(2) process cuts off after lag 2.

Another class of times series models is the moving average models, in which realizations are deemed to emanate from a linear combination of historical random shocks. A first order moving average model, or MA(1), is represented as follows:

$$y_t=\mu+\epsilon_1-\theta_1\epsilon_{t-1} \quad \text{(Equation 19)}$$

where $\theta_1$ is an unknown, to be estimated parameter, and $\epsilon_t$ and $\epsilon_{t-1}$ represent a current and immediately preceding random shock, respectively (with distributional properties as earlier specified for the autoregressive models).

The mean of the MA(1) process is simply p, and the variance is given by $$\gamma_0=\sigma^2(1+\theta_1{}^2) \quad \text{(Equation 20)}$$

The autocorrelation coefficients of the MA(1) process are given by $$\rho_k = \frac{-\theta_1}{1+\theta_1^2};\ k=1 \quad \text{(Equation 21)}$$

$$\rho_k = 0;\ k>1.$$

Accordingly, the ACF for the MA(1) process cuts off at lag 1, while the PACF tails off.

The autoregressive-moving average model (ARMA) involves combining the two previous model classes into a unified form. A model which is first order in both components, known as ARMA(1,1), is represented as follows:

$$y_1=\xi+\phi_1 y_{t-1}+\epsilon_t-\theta_1\epsilon_{t-1} \quad \text{(Equation 22)}$$

Combining the model forms results in a powerful mathematical representation, which, through careful parameter selection, can accurately model a variety of industrial, physical, and business processes. The mean of the ARMA (1,1) process is $$\mu = \frac{\xi}{1-\phi_1} \quad \text{(Equation 23)}$$

which is identical to the mean of the AR(1) process studied earlier. The variance of the ARMA(1,1) process is $$\gamma_0=\phi_1\gamma_1+\sigma^2[1-\theta_1(\phi_1-\theta_1)] \quad \text{(Equation 24)}$$

and the autocovariances are given by $$\gamma_1=\phi_1\lambda_0-\theta_1\sigma^2$$

$$\gamma_k=\phi_1\gamma_{k-1};k\geqq 2. \quad \text{(Equation 25)}$$

The autoregressive-moving average model may be extended to higher order in either the autoregressive or the moving average components, or both, as dictated by the specific needs of the modeling environment. A full second order model, the ARMA(2,2), is represented by:

$$y_t=\xi+\phi_1 y_{t-1}+\phi_2 y_{t-2}+\epsilon_t-\theta_1\epsilon_{t-1}-\theta_2\epsilon_{t-2} \quad \text{(Equation 26)}$$

Qualitatively, this model presumes that the current realization is a linear combination of the past two realizations, three consecutive random system shocks, and a term related to the mean of the process.

All of the times series models discussed thus far in this section (AR, MA, and ARMA) all presuppose that they are modeling stationary processes. However, these procedures can be easily extended to non-stationary processes through a transformation algorithm known as differencing. Consider a backward difference operator whose operation is defined as:

$$\nabla y_t=y_t-y_{t-1} \quad \text{(Equation 27)}$$

This operator has the ability to often transform a non-stationary process into a stationary process.

The application of the difference operator results in a stationary time series in this instance. At times more than one differencing operation is required to achieve stationarity in the process in question; it is helpful in these instances to introduce the backward-shift operator B, defined as \=1=B. The backward shift operator forces a backwards indexing of variables, such that $By_t=y_{t-1}$, which provides a computationally efficient method of expanding models from notational to operational forms (as will be demonstrated). Second order differencing can be expressed as $^{\backslash 2}=(1-B)^2$, a notation that will be utilized shortly.

Implementation of differencing prior to time series modeling leads to an extremely versatile and powerful class of models known as autoregressive integrated moving average models, or ARIMA. The order of each of the three components is specified in the model notation as p,d,q: for example, the ARIMA(2,1,1) notation refers to a model with a second order autoregressive component, first order differencing component, and a first order moving average component. The ARIMA(2,1,1) process may be succinctly expressed as $$(1-\phi_1 B-\phi_2 B^2)\nabla y_t=(1-\theta_1 B)\epsilon_t \quad \text{(Equation 28)}$$

Substituting the backward shift operator for the backward shift operator and expanding yields:

$$(1-\phi_1 B-\phi_2 B^2)(1-B)y_t=(1-\theta_1 B)\epsilon_t \quad \text{(Equation 29)}$$

which may be expanded to $$(1-\phi_1 B-\phi_2 B^2-B+\phi_1 B^2+\phi_2 B^3)y_t=(1-\theta_1 B)\epsilon_t \quad \text{(Equation 30)}$$

Allowing the backward shift operator to index the $y_t$ and the $_t$ terms results in $$y_1 y_{t-1}-\phi_2 y_{t-2}-y_{t-1}+\phi_1 y_{t-2}+\phi_2 y_{t-3}=\epsilon_t-\theta_1\epsilon_{t-1} \quad \text{(Equation 31)}$$

which upon simplification yields:

$$y_t=(1+\phi_1)y_{t-1}-(\phi_1-\phi_2)y_{t-2}-\phi_2 y_{t-3}\epsilon_1-\theta_1\epsilon_{t-1} \quad \text{(Equation 32)}$$

While specific embodiments of the present invention have been provided, it is to be understood that these embodiments are for illustration purposes and not limiting. Many additional embodiments will be apparent to persons of ordinary skill in the art reading this disclosure. Thus, the present invention is limited only by the following claims.

What is claimed is:

1. A chemical-mechanical polishing process, the process comprising:

performing chemical-mechanical polishing on an entire first wafer lot;

determining a normalized polish rate from the chemical-mechanical polishing of the first wafer lot; and predicting a process time for a second wafer lot using the normalized polish rate derived from the first wafer lot.

2. The process of claim 1, wherein performing the chemical-mechanical polishing of the entire first wafer lot is accomplished without look ahead polishing of a first article wafer.

3. The process of claim 1, wherein determining the normalized polish rate comprises calculating a polish rate from a polish time and a polish distance of at least one wafer from the first wafer lot and normalizing the polish rate using a device and layer coefficient (DLC) relating to the first wafer lot.

4. The process of claim 3, wherein the DLC is calculated by averaging multiple raw DLC values relating to the first wafer lot.

5. The process of claim 3, wherein a compensated rate factor (CRF) relating to the actual and target rates of a qualification test is also used in normalizing the polishing rate.

6. The process of claim 1, wherein predicting the process time for the second wafer lot is accomplished using a model to analyze data from the chemical-mechanical polishing of at least one prior wafer lot.

7. The process of claim 6, wherein the model comprises an autoregressive integrated moving average (ARIMA) model.

8. The process of claim 7, wherein the ARIMA model comprises an autoregressive component, a differencing component, and a moving average component.

9. The process of claim 8, wherein the autoregressive component is second order, the differencing component is first order, and the moving average component is first order.

10. The process of claim 1, further comprising:

performing chemical-mechanical polishing on an entirety of the second wafer lot;

determining a normalized polish rate from the chemical-mechanical polishing of the second wafer lot; and predicting a process time for a third wafer lot using the normalized polish rates derived from the first and second wafer lots.

11. A polishing apparatus for chemical-mechanical planarization (CMP) of semiconductor wafers, the apparatus comprising:

a CMP machine configured to polish an entire wafer lot without look ahead polishing of a first article wafer;

a control mechanism operatively coupled to the CMP machine for controlling a process time for polishing wafer lots; and a computing mechanism operatively coupled to the control mechanism for calculating a normalized polish rate for a preceding wafer lot and for predicting a process time for a next wafer lot using the normalized polish rate derived from the preceding wafer lot.

12. The apparatus of claim 11, wherein the computing mechanism calculates the normalized polish rate by determining a polish rate from a polish time and a polish distance of at least one wafer from the preceding wafer lot and by normalizing the polish rate using a device and layer coefficient (DLC) relating to the preceding wafer lot.

13. The apparatus of claim 12, wherein the computing mechanism further calculates the normalized polish rate by determining and using a compensated rate factor (CRF) relating to the actual and target rates of a qualification test.

14. The apparatus of claim 11, wherein the computing mechanism predicts the process time for the next wafer lot using a model to analyze data from the chemical-mechanical polishing of at least one prior wafer lot.

15. The apparatus of claim 14, wherein the model used by the computing mechanism comprises an autoregressive integrated moving average (ARIMA) model.

16. The apparatus of claim 15, wherein the ARIMA model comprises an autoregressive component, a differencing component, and a moving average component.

17. The apparatus of claim 16, wherein the autoregressive component is second order, the differencing component is first order, and the moving average component is first order.

18. A chemical-mechanical polishing apparatus, the apparatus comprising:

means for performing chemical-mechanical polishing on an entire preceding wafer lot;

means for determining a normalized polish rate from the chemical-mechanical polishing of the preceding wafer lot; and means for predicting a process time for a next wafer lot using the normalized polish rate derived from the preceding wafer lot.

19. The apparatus of claim 18, wherein the means for determining the normalized polish rate calculates a polish rate from a polish time and a polish distance of at least one wafer from the preceding wafer lot and normalizing the polish rate using a device and layer coefficient (DLC) relating to the preceding wafer lot.

20. The apparatus of claim 18, wherein the means for predicting a process time uses an autoregressive integrated moving average (ARIMA) model to analyze data from the chemical-mechanical polishing of at least one prior wafer lot.

* * * * *